United States Patent [19]

Williams

[11] Patent Number: 4,542,721

[45] Date of Patent: Sep. 24, 1985

[54] STARTING SYSTEM/HYDRAULIC SYSTEM INTERLOCK

[75] Inventor: Hugh K. Williams, Davenport, Iowa

[73] Assignee: Caterpillar Tractor Co., Peoria, Ill.

[21] Appl. No.: 597,325

[22] Filed: Apr. 6, 1984

[51] Int. Cl.[4] ..... F02N 11/08

[52] U.S. Cl. ..... 123/179 K; 123/198 C; 417/10

[58] Field of Search ..... 123/179 R, 179 A, 179 B, 123/179 K, 198 C; 417/364, 34, 10

[56] References Cited

U.S. PATENT DOCUMENTS

| | | | |
|---|---|---|---|
| 2,213,743 | 9/1940 | Miner | 417/364 |
| 3,574,288 | 4/1971 | Barth et al. | 123/179 K |
| 4,033,311 | 7/1977 | Burson | 123/179 K |
| 4,084,536 | 4/1978 | Stansbury | 123/179 K |
| 4,091,889 | 5/1978 | Brown et al. | 180/101 |
| 4,136,752 | 1/1979 | Friesen et al. | 180/101 |
| 4,211,314 | 7/1980 | Clason | 192/4 A |
| 4,220,050 | 9/1980 | Friesen et al. | 74/2 |
| 4,267,804 | 5/1981 | Rypka | 123/179 K |
| 4,273,224 | 6/1981 | Brown et al. | 192/4 A |
| 4,295,540 | 10/1981 | Hildebrecht | 180/271 |
| 4,328,950 | 5/1982 | Aspinwall | 251/297 |
| 4,342,335 | 8/1982 | Reinicker et al. | 137/636.2 |
| 4,353,394 | 10/1982 | Loup | 137/625.65 |

*Primary Examiner*—Andrew M. Dolinar
*Attorney, Agent, or Firm*—Joseph W. Keen

[57] ABSTRACT

A system for ensuring that hydraulic valves are in an unactuated position during starting of an engine. An ignition switch, when suitably positioned, delivers a starting signal to a starting motor operationally coupled to the vehicle engine. A relay system responsive to the starting signal energizes a solenoid structure which permits the valves to move to their unactuated positions or, alternatively, a relay which obstructs the starting signal to the starting motor in response to a signal from a switch network indicating at least one valve is in an actuated position.

2 Claims, 2 Drawing Figures

STARTING SYSTEM/HYDRAULIC SYSTEM INTERLOCK

DESCRIPTION

1. Technical Field

This invention relates to means for starting a vehicle and, more particularly, to an electrical/hydraulic interlock which ensures that vehicle fluid valves are in their unactuated position when the vehicle engine is started.

2. Background Art

Vehicles such as construction equipment often have hydraulic valves which are supplied with pressurized fluid by engine driven pumps and which include detents or other means for holding the hydraulic valves in an actuated position without continued operator exertion. Such detents permit an operator to initiate movement of hydraulically powered implements by positioning the hydraulic valves and subsequently releasing the valves to change the focus of his attention. Until disengaged by a kickout apparatus, the detents maintain the valves' position and implements' movement.

In some circumstances the vehicle engine may cease operation either through operator initiated action or from other causes while one or more fluid valves are held in an actuated mode by such detents. When a fluid valve mounted on a vehicle is positioned in an actuation mode such as by detents during starting of the vehicle's engine, substantial energy can be parasitically diverted from starting the engine to driving the fluid pump and moving the associated hydraulic implement. The power diverted from the intended engine starting function by such detented valves increases in importance as the time period between engine shut down and restart is increased and during restart in cold environments.

When the diverted power becomes too large, the power available for starting may be less than the minimum required. To maximize the power dedicated to starting the engine, it is desirable to minimize parasitic loads on the engine starting mechanism during the starting sequence of the engine.

U.S. Pat. No. 4,033,311 which issued July 5, 1977, illustrates an ignition system with hazardous start inhibiting interlock which, at the time of engine starting, blocks the flow of current pulses from a pulse source to a primary winding unless the clutch, transmission, or other device occupies a predetermined position so that the vehicle engine cannot be started. U.S. Pat. Nos. 4,091,889 by Brown et al., 4,136,752 by Friesen et al., and 4,220,050 by Friesen et al. illustrate brake systems which include provisions for brake actuation during operator absence from the operator seat. U.S. Pat. No. 4,273,224 by Brown et al. illustrates a system for inhibiting powered travel by the utilizing vehicle against an engaged parking brake. U.S. Pat. No. 4,211,314 to Clason illustrates an apparatus for preventing parking brake application if the transmission is not in neutral and prevents shifting the transmission from neutral before the parking brake is released. None of the aforementioned patents apply to or are readily adaptable for ensuring hydraulic valve positioning in a non-actuation mode prior to starting the vehicle's engine.

DISCLOSURE OF THE INVENTION

The invention generally comprises an engine, an electrical motor for starting the engine, an ignition switch for delivering a starting signal to the motor, a plurality of fluid valves which are movable between actuation and non-actuation positions, and means which are responsive to the starting signal for either moving actuated valves to an unactuated position or blocking delivery of the starting signal to the starting motor when any of the valves are in the actuated position.

BEST MODE FOR CARRYING OUT THE INVENTION

Figure 1:
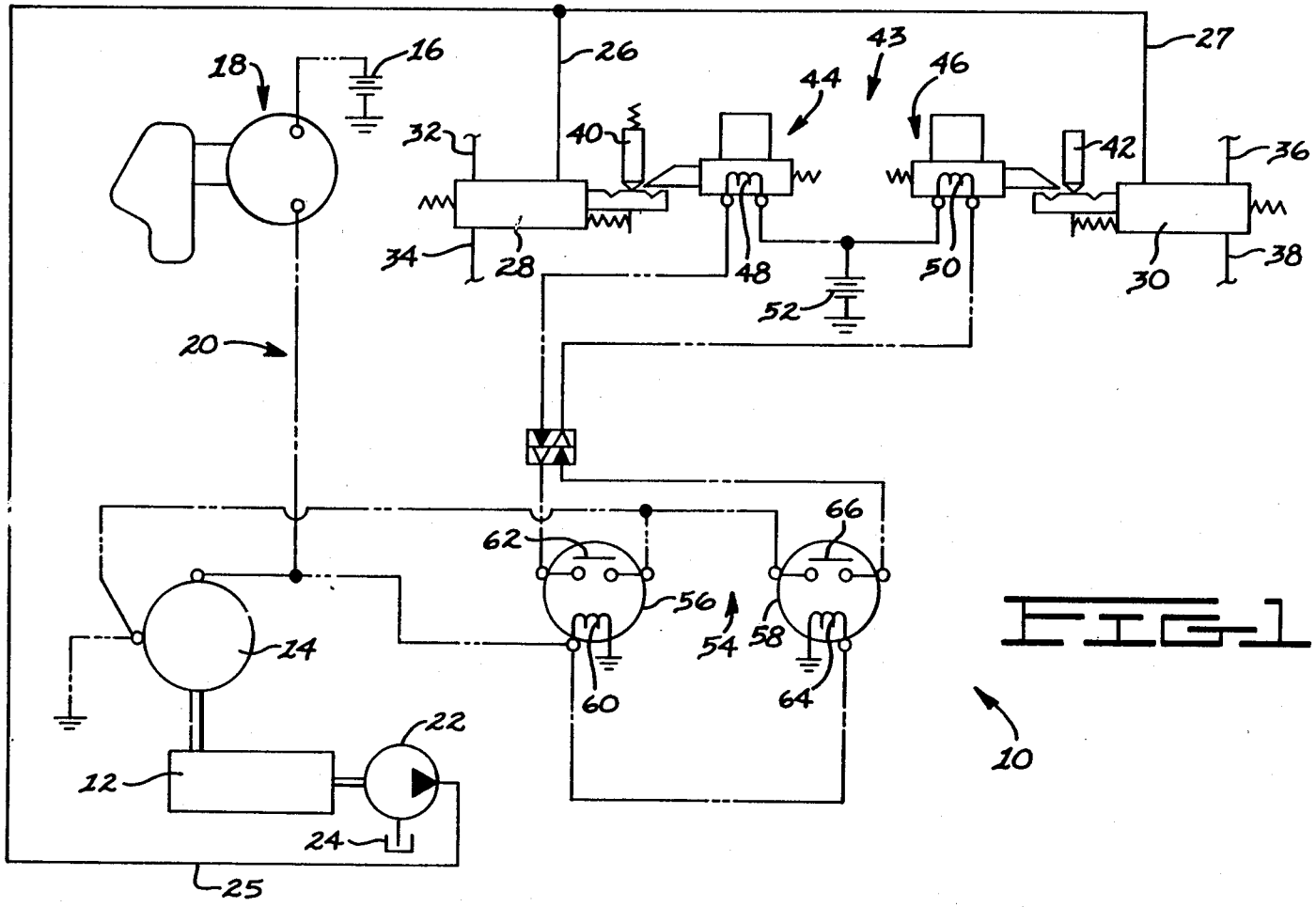
FIG. 1 is a schematic view of one embodiment of the present invention.

As used herein, like reference numerals refer to like elements. Referring now to the drawings in detail, FIG. 1 illustrates an operating system 10 having an engine 12 whose operation can be initiated by a starting motor 14 coupled thereto. The starting motor 14 is selectively actuated by electrically interconnecting an electrical voltage source such as a battery 16 to the starting motor 14 by means of an ignition switch 18 and appropriate electrical wiring 20. The engine 12, when in the operating mode, drives a hydraulic pump 22 which draws hydraulic oil or other fluid from a reservoir 24 and discharges it into a fluid line 25 which bifurcates into fluid conduits 26 and 27. A pair of self centering or self neutralizing hydraulic control valves 28 and 30 illustrated in their unactuated position respectively receive fluid through the conduits 26 and 27 and, when appropriately actuated, deliver fluid through supply lines 32 and/or 34 and 36 and/or 38, respectively. For purposes of simplicity the supply lines 32,34,36 and 38 are schematically illustrated as terminating, but it is to be understood that those lines actually connect to fluid utilizing implements (not shown) or, in the case of pilot control systems in which the control valves 28 and 30 are actually pilot valves, to the main control valves (not shown).

When the valves 28 and 30 are moved a sufficient extent in either actuation direction, a pair of detents 40 and 42 respectively hold the valves in a semi-fixed, actuated state until the implements fluidly connected to those activated valves have cycled to one of their extreme positions or until the operator exerts a force on the valves sufficient to remove them from the detented position. A detent disengagement apparatus 43 for the illustrated detents 40 and 42 by example respectively includes solenoid apparatus 44 and 46 which, when electrically energized, induce release of the detents 40 and 42. The solenoids 44 and 46 have respective windings 48 and 50 whose constructions are well-known to those skilled in the art. One end of each winding is electrically connected to a battery or other voltage source 52.

The illustrated switching apparatus 54 includes a first and second relay 56 and 58, respectively. As is well-known in the art, the relay 56 has an activating coil 60 and a contactor portion 62 and the relay 58 has an actuating coil 64 and a contactor portion 66. One end of the contactor portion 62 is electrically connected to the other end of the winding 48 and one end of the contactor 66 is electrically connected to the other end of the winding 50. The other end of each of the contactors 62 and 66 is electrically grounded. One end of each of the coils 60 and 64 is electrically grounded while the other end of each of the coils is electrically connected to the starting switch 18.

Figure 2:
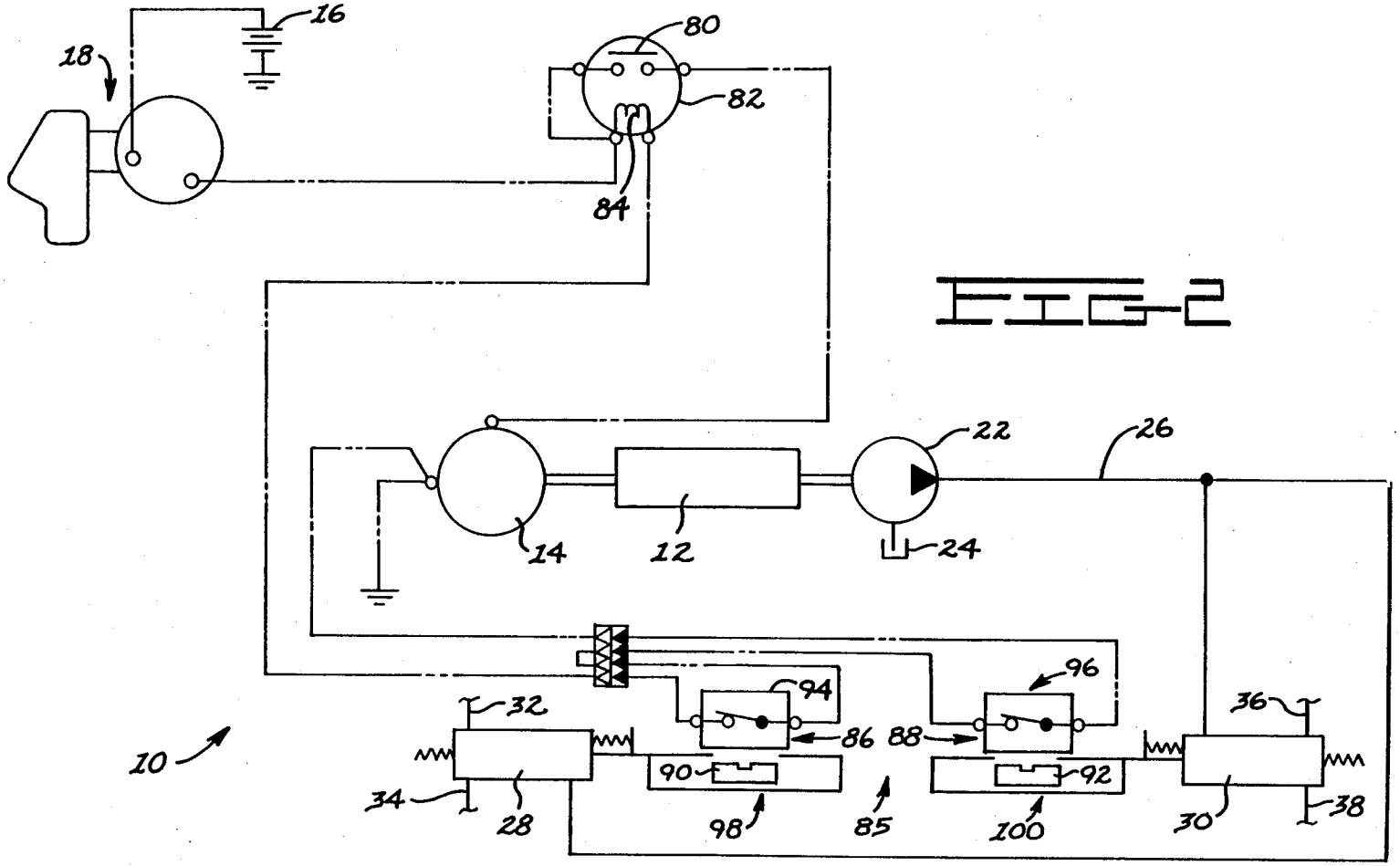
FIG. 2 is a section embodiment of the present invention.

FIG. 2 is an alternate embodiment of system 10 in which the control valves 28 and 30 utilize mechanical detent release means which do not interact with other elements of the system 10 and are thus not illustrated. The ignition switch 18 is connected to the starting motor 14 via a contactor portion 80 of a relay 82 which also includes an actuating coil 84. The ignition switch 18 is also electrically grounded via the actuating coil 84 and a switch network 85 such as serially arranged reed switches 86 and 88. The reed switches 86 and 88 respectively include magnets 90 and 92 and switch elements 94 and 96. The magnet and switch elements of each reed switch are preferably mounted on non-magnetic interconnected structure so as to prevent relative movement therebetween. The valves 28 and 30 respectively include linkage structure or shield mechanisms 98 and 100 which are movable with the valves so as to protrude between the magnet and switch elements of each switch when the valve is in the actuated detent position.

INDUSTRIAL APPLICABILITY

System 10 as illustrated in FIGS. 1 and 2 effectively eliminate parasitic loses associated with initiating an engine start sequence with hydraulic control valves in an actuated position. Eliminating such parasitic loses allows the maximum power available to the starting motor 14 to be dedicated to starting the engine 12. In cold environments and in cases where the battery 16 or other electrical supply has decreased effectiveness, the present invention enjoys a decided advantage over previous systems.

When a start sequence is initiated for the system 10 of FIG. 1, electrical communication between the battery 16 and the starting motor 14 is provided by the ignition switch 18. Simultaneously therewith the actuating coils 60 and 64 of the relays 56 and 58 are electrically energized. Upon energization of the coils 60 and 64, the contactor portions 62 and 66 of the relays 56 and 58 are closed and electrical energy supplied by the battery 52 is allowed to flow through the windings 48 and 50 of solenoids 44 and 46, respectively, so as to disengage the detent mechanisms 40 and 42 which, in turn, permits the self-centering control valves 28 and 30 to assume the illustrated, unactuated position. Of course, the battery 52 may actually constitute the battery 16. Thus, when the operator moves the ignition switch 18 to its engine starting position, either or both of the control valves 28 and 30, if in the actuated position, are moved to their unactuated position.

On the other hand, when a start sequence is initiated for the system 10 embodiment illustrated in FIG. 2, electrical energy from the battery 16 is conducted through the contactor portion 80 of the relay 82 only when the reed switches 86 and 88 are both in the closed, conducting position. The switch elements 94 and 96 of the switches 86 and 88 respectively are in the closed, conducting mode when the shielding devices 98 and 100 respectively occupy the illustrated unobstructing position corresponding to the valves 28 and 30 being in the unactuated position. When either of the valves 28 or 30 occupies an actuated position such as would occur when they are in detent, the corresponding shielding mechanism 98 or 100 would separate the actuated valve's magnet 90,92 and switch element 94,96 so as to shield that switch element from the associated magnet's magnetic field, and cause that switch element to move to the open, non-conducting position. As such, if either switch 86 or 88 is in the open position, electrical energy will not flow through the actuating coil 84 and contactor portion 80 of the relay 82 will occupy an open, nonconducting position so as to obstruct electrical energy flow to the starting motor 14.

Of course, when both switches 86 and 88 are in their closed modes which correspond to the unactuated position of valves 28 and 30, electrical energy will flow through the actuating coil 84 and cause the contactor portion 80 to close and permit energization of the starting motor 14. The switches 86 and 88 are moved between open and closed states by magnetic fields rather than physical contact and are, thus, preferred inasmuch as extended usage will not result in debilitating wear.

The operating mode for system 10 of FIG. 1 simultaneously provides electrical energy to the starting motor 14 and moves the valves 28 and 30, when in the actuated position, to their unactuated position upon suitable movement of the starting switch 18. The embodiment of system 10 illustrated in FIG. 2, however, prevents energization of the starting motor 14 whenever either control valve 28 or 30 is in its actuated position. Accordingly, the FIG. 2 embodiment of system 10 requires additional operator action to move the actuated valve (28 or 30) to its unactuated position prior to being able to start the vehicle engine 12 with the starting motor 14.

It should now be apparent that an improved operating system 10 has been provided for ensuring against fluid valve actuation during starting of the vehicle engine 12. The illustrated embodiments of the system 10 eliminate parasitic loads exerted on the starting motor 14 by actuated control valves by ensuring that the fluid control valves 28 and 30 are in their neutral, unactuated position prior to starting the engine. Accordingly, the probability that the engine 12 will start is increased since all electrical energy supplied to the starting motor 14 is dedicated to the task of starting the engine 12.

I claim:

1. A system for ensuring that hydraulic valves for regulating fluid flow supplied by an engine driven pump are in an unactuated position prior to starting the engine, said system comprising:

(a) an engine;

(b) a starter motor engageable with said engine;

(c) means for delivering a signal to said starter motor to start said engine;

(d) a plurality of valves each movable between an actuated position and an unactuated position; and (e) actuating means responsive to said starting signal for one of automatically moving said valves occupying said actuated position to an unactuated position and blocking delivery of said starting signal to said starting motor in response to any of said valves being in said actuated position, said automatic valve moving actuating means including (a) disengagement means for driving said valves to the unactuated position in response to an engagement signal which is separate from said starting signal and (b) switching means for delivering said engagement signal to said disengagement means only in response to said starting signal, said signal blocking actuating means including (a) first switching means for blocking delivery of said starting signal to said starting motor in response to a valve position indicator signal and (b) indicator means for electrically delivering an indicator signal in response to any of said valves being in said actuated position, wherein said indicator means includes linkage structure being movable with said valves between first and second positions which respectively correspond to said valves' actuated and unactuated positions; and second switching means mounted independently of said linkage structure for delivering said indicator signal to said first switching means in response to said linkage structure occupying said first position.

2. The system of claim 1 wherein said second switching means comprises:

receiving means for delivering said indicator signal in response to receiving a position signal; and sending means for delivering a position signal to said receiving means when said linkage structure is disposed therebetween.

* * * * *